US008508461B2

(12) United States Patent
Okuyama

(10) Patent No.: US 8,508,461 B2
(45) Date of Patent: Aug. 13, 2013

(54) ELECTRO-OPTICAL DEVICE, ELECTRONIC APPARATUS, AND METHOD OF DRIVING ELECTRO-OPTICAL DEVICE WITH VARIABLE SUBFIELD DRIVING FOR TEMPERATURE COMPENSATION

(75) Inventor: Tomoyuki Okuyama, Chino (JP)

(73) Assignee: Seiko Epson Corporation, Tokyo (JP)

( * ) Notice: Subject to any disclaimer, the term of this patent is extended or adjusted under 35 U.S.C. 154(b) by 825 days.

(21) Appl. No.: 12/691,900

(22) Filed: Jan. 22, 2010

(65) Prior Publication Data

US 2010/0188444 A1 Jul. 29, 2010

(30) Foreign Application Priority Data

Jan. 26, 2009 (JP) ..... 2009-014365

(51) Int. Cl.
*G09G 3/36* (2006.01)
*G09G 5/10* (2006.01)
*G09G 3/10* (2006.01)

(52) U.S. Cl.
USPC ..... 345/101; 345/87; 345/691; 315/169.3

(58) Field of Classification Search
USPC ..... 345/76–107; 315/169.3
See application file for complete search history.

(56) References Cited

U.S. PATENT DOCUMENTS

| | | | | |
|---|---|---|---|---|
| 7,002,537 | B1 * | 2/2006 | Ito | 345/87 |
| 2004/0196233 | A1 | 10/2004 | Shimizu | |
| 2008/0246698 | A1 * | 10/2008 | Eom | 345/76 |
| 2008/0316148 | A1 * | 12/2008 | Takeuchi et al. | 345/63 |
| 2009/0066621 | A1 * | 3/2009 | Iwamoto et al. | 345/88 |

FOREIGN PATENT DOCUMENTS

| | | |
|---|---|---|
| JP | P3918536 | 2/2007 |
| JP | 2008-111925 | 5/2008 |

* cited by examiner

*Primary Examiner* — Bipin Shalwala
*Assistant Examiner* — Ryan A Lubit
(74) *Attorney, Agent, or Firm* — Maschoff Brennan

(57) ABSTRACT

An electro-optical device includes pixels that is driven in response to an ON voltage or an OFF voltage supplied to the signal lines at a time when each of scanning lines is selected, a scanning line driving circuit that sequentially selects the scanning lines in each of a plurality of subfields within a field, a signal line driving circuit that outputs the ON voltage to the signal lines in at least one temperature compensation subfield and outputs either the ON voltage or the OFF voltage to each of the signal lines in accordance with a designated gray scale of each of the pixels in each of a plurality of gray scale control subfields, which is different from the temperature compensation subfield, and a control unit that sets a time length of the temperature compensation subfield to be changed in accordance with the temperature detected by a temperature detecting unit.

6 Claims, 9 Drawing Sheets

ELECTRO-OPTICAL DEVICE, ELECTRONIC APPARATUS, AND METHOD OF DRIVING ELECTRO-OPTICAL DEVICE WITH VARIABLE SUBFIELD DRIVING FOR TEMPERATURE COMPENSATION

BACKGROUND

1. Technical Field

The present invention relates to technology for representing a gray scale by applying either an ON voltage or an OFF voltage to each pixel in each of a plurality of subfields within a field.

2. Related Art

Typically, subfield driving in which either an ON voltage or an OFF voltage is selectively applied to an electro-optical element (for example, a liquid crystal element) in each of a plurality of subfields, which is acquired by dividing a field, has been proposed (for example, Japanese Patent No. 3918536). In the subfield driving, a gray scale is represented by changing the ratio of a time during which the ON voltage is applied to the electro-optical element to a total time of a field in accordance with a designated gray scale.

However, there are cases where the behavior of the electro-optical element depends on the temperature. FIG. 13 is a graph showing a change in the gray scale of the electro-optical element (liquid crystal element) over time for a plurality of cases where the temperatures are different from one another. In FIG. 13, a change in the transmittance is exemplified in the case where the ON voltage is applied to a liquid crystal element of the normally-white mode, in which the transmittance becomes the minimum (black display) at the time of application of the ON voltage, from a time point t1 and the OFF voltage is applied to the liquid crystal element from a time point t2.

The viscosity of the liquid crystal increases as the temperature is lowered. Thus, as can be noticed from FIG. 13, as the temperature of the liquid crystal element is lower, the speed at which the transmittance is increased after the OFF voltage is applied (after elapse of the time point t2) is decreased. Accordingly, there is a problem in that the gray scale actually perceived by an observer changes in accordance with the temperature of the liquid crystal element (in particular, the gray scale becomes higher as the temperature of the liquid crystal element is higher) even in the case where the time interval during which the ON voltage is applied is the same.

SUMMARY

An advantage of some aspects of the invention is that it provides technology for decreasing a change in the gray scale due to the temperature under the subfield driving.

According to a first aspect of the invention, there is provide electro-optical device including: a plurality of pixels that is disposed in correspondence with intersections of a plurality of scanning lines and a plurality of signal lines and is driven in response to an ON voltage or an OFF voltage supplied to the signal lines at a time when the scanning line is selected; a scanning line driving circuit that sequentially selects the plurality of the scanning lines in each of a plurality of subfields within a field; a signal line driving circuit that outputs the ON voltage to the plurality of signal lines at the time when the scanning lines are selected in at least one temperature compensation subfield among the plurality of subfields and outputs either the ON voltage or the OFF voltage to each of the plurality of signal lines in accordance with a designated gray scale of a pixel corresponding to the corresponding scanning line and the corresponding signal line at a time when the scanning lines selected in each of a plurality of gray scale control subfields, which is different from the temperature compensation subfield, out of the plurality of subfields; a temperature detecting unit that detects a temperature; and a control unit that sets a time length of the temperature compensation subfield to be changed in accordance with the temperature detected by the temperature detecting unit. The control unit, for example, sets each temperature compensation subfield to a longer time interval as the temperature detected by the temperature detecting unit becomes higher.

According to the electro-optical device having the above-described configuration, the time length of the temperature compensation subfield, during which the ON voltage is forcedly applied to the pixel, is controlled to be changed in accordance with the detection temperature detected by the temperature detecting unit. Accordingly, even when the response characteristics of the pixel (for example, the liquid crystal element) are changed due to the temperature, a change in the gray scale of each pixel can be decreased. Here, the temperature detected by the temperature detecting unit is the temperature of each element of the electro-optical device or the surroundings of the electro-optical device and is a concept that includes a temperature that changes in accordance with the temperature of the pixel (electro-optical element) other than the temperature of the pixel.

In the above-described electro-optical device, it may be configured that the field is divided into a plurality of unit periods, and each of the plurality of unit periods includes the temperature compensation subfield and the gray scale control subfield. In such a case, since the temperature compensation subfield is set for each gray scale control subfield, compared to a configuration in which only one temperature control subfield is set within the field, the advantage in that the change in the gray scale of each pixel due to the temperature is decreased becomes remarkable.

In the above-described electro-optical device, the signal line driving circuit may be configured to include: a plurality of logic circuits corresponding to the plurality of signal lines; and a signal output circuit that supplies direction data that designates the ON voltage or the OFF voltage in a time-division manner to each of the plurality of logic circuits. In such a case, each of the plurality of logic circuits receives a control signal (for example, the control signal ENB shown in FIG. 5) that is set to a first level (the low level shown in FIG. 5) at a time when the scanning line is selected in the temperature compensation subfield and is set to a second level (the high level shown in FIG. 5) at a time when the scanning line is selected in each of the plurality of gray scale control subfields and outputs the ON voltage to the signal line within a period in which the control signal is at the first level regardless of the direction data and outputs the ON voltage or the OFF voltage in accordance with the direction data to the signal line in a period in which the control signal is at the second level. In the case, since each logic circuit outputs the ON voltage regardless of the direction data within the period during which the control signal is at the first level, a time interval corresponding to one period of the control signal can be acquired as the period of the direction data that is output by the signal output circuit. Accordingly, there is an advantage that the operating speed of the signal line driving circuit is decreased. Each logic circuit, for example, is configured to include a negative AND circuit to which the control signal and the direction data are input.

In the above-described electro-optical device, the scanning line driving circuit may be configured to include: a transmission circuit that generates a plurality of transmission signals in which transmission pulses acquired by sequentially shifting a start pulse are disposed; and a pulse generating circuit that generates a first selection pulse corresponding to a leading edge of each of the transmission pulses and a second selection pulse corresponding to a trailing edge of each of the transmission pulses and outputs the selection pulses to the scanning lines. In such a case, the first selection pulse directs to select the scanning line in one of the temperature compensation subfield and the gray scale control subfield, and the second selection pulse directs to select the scanning line in the other of the temperature compensation subfield and the gray scale control subfield. In addition, the control unit controls a pulse width of the start pulse in accordance with the temperature detected by the temperature detecting unit. In the case, the first selection pulse and the second selection pulse that are used for directing to select the scanning line are generated from one start pulse. Accordingly, compared to a configuration in which one selection pulse is generated from one start pulse, there is an advantage that the number of start pulses that are needed for selecting the scanning line is decreased.

According to a second aspect of the invention, there is provided an electro-optical device including: a pixel that is driven in accordance with an ON voltage or an OFF voltage; a driving circuit that applies the ON voltage to the pixel in at least one temperature compensation subfield among a plurality of subfields within a field and applies either the ON voltage or the OFF voltage in accordance with a designated gray scale of the pixel to the pixel in each of a plurality of gray scale control subfields, which is different from the temperature compensation subfield, out of the plurality of subfields; a temperature detecting unit that detects a temperature; and a control unit that sets a time length of the temperature compensation subfield to be changed in accordance with the temperature detected by the temperature detecting unit. Also in the above-described aspect, the time length of the temperature compensation subfield, during which the ON voltage is forcedly applied to the pixel, is controlled to be changed in accordance with the detection temperature detected by the temperature detecting unit. Accordingly, even when the response characteristics of the pixel (for example, the liquid crystal element) are changed due to the temperature, a change in the gray scale of each pixel can be decreased.

The electro-optical device according to an embodiment of the invention is used in various electronic apparatuses. A typical example of the electronic apparatus is an apparatus that uses the electro-optical device as a display device. As examples of electronic apparatuses according to embodiments of the invention, there are a personal computer and a cellular phone. In addition, the electro-optical device according to an embodiment of the invention is also used as a display device of the projection type that projects display light to a display surface (for example, a screen), in addition to a display device that outputs display light that directly reaches an observer. In a projection-type display device, emission light having high intensity is emitted from a light source, and accordingly, the temperature of the electro-optical device tends to change easily. Therefore, an embodiment of the invention capable of suppressing a change in the gray scale due to the temperature can be appropriately used for such a projection-type display device.

The invention may be implemented as a method of driving the above-described electro-optical device. According to the method of driving the electro-optical device, sequentially selecting a plurality of the scanning lines in each of a plurality of subfields within a field; outputting the ON voltage to the plurality of signal lines at the time when the scanning line is selected in at least one temperature compensation subfield among the plurality of subfields and outputs either the ON voltage or the OFF voltage to each of the plurality of signal lines in accordance with a designated gray scale of a pixel corresponding to the corresponding scanning line and the corresponding signal line at a time when the scanning lines selected in each of a plurality of gray scale control subfields, which is different from the temperature compensation subfield, out of the plurality of subfields; detecting a temperature; and setting a time length of the temperature compensation subfield to be changed in accordance with the detected temperature are included. According to the above-described method, the same advantages as those of the above-described electro-optical device can be acquired.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
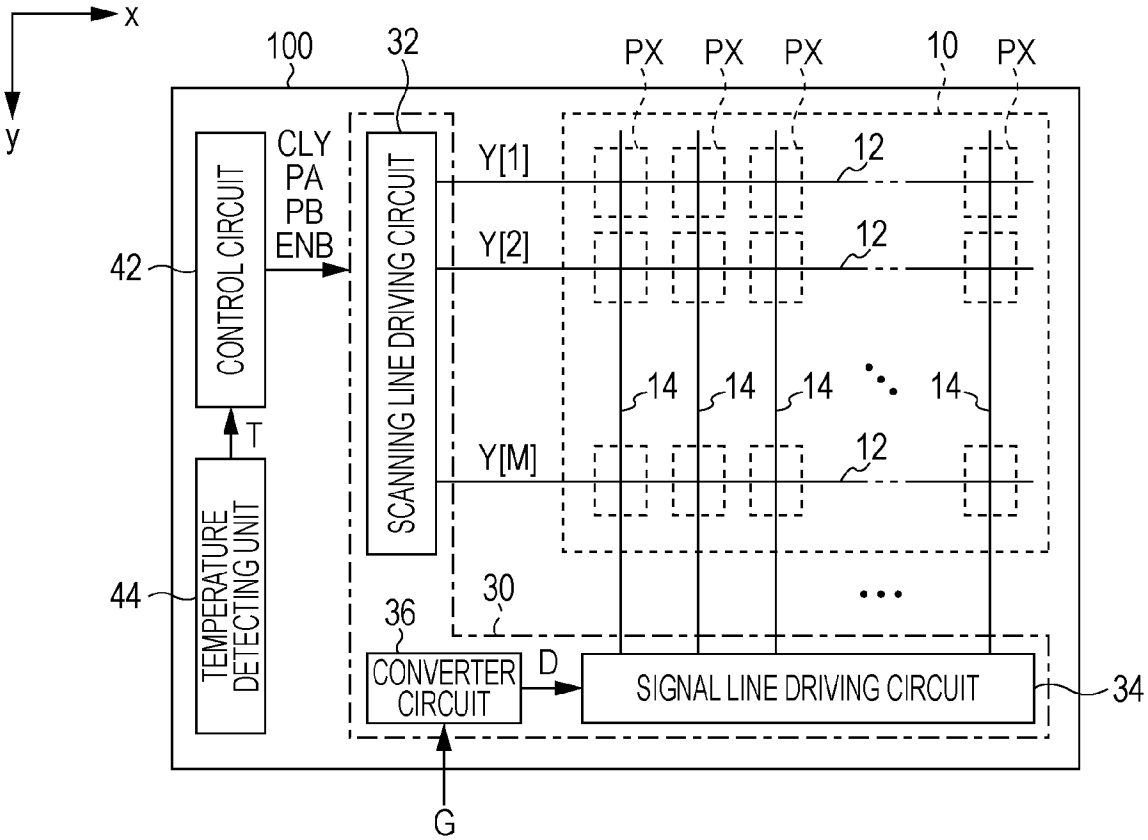
FIG. 1 is a block diagram of an electro-optical device according to a first embodiment of the invention.

Hereinafter, an electro-optical device (liquid crystal display device) according to a first embodiment of the invention, in which liquid crystal elements are used in pixels, will be described. As shown in FIG. 1, the electro-optical device 100 according to the first embodiment includes a pixel unit (display area) 10, a driving circuit 30, a control circuit 42, and a temperature detecting unit 44. The driving circuit 30 and the control circuit 42 are mounted on a surface of a substrate in which the pixel unit 10 is formed or a surface of a wiring substrate connected to the substrate.

In the pixel unit 10, M scanning lines 12 extending in direction x and N signal lines 14 extending in direction y intersecting with direction x are formed (here, M and N are natural numbers). In positions corresponding to intersections of the scanning lines 12 and the signal lines 14, pixels PX are disposed. Accordingly, a plurality of the pixels PX is arranged in the shape of a matrix of vertical M rows x horizontal N columns.

Figure 2:
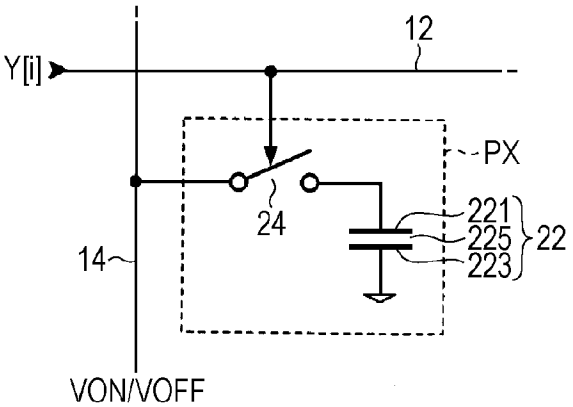
FIG. 2 is a circuit diagram of a pixel.

In FIG. 2, a pixel PX of the j-th column (j=1 to N) that belong to the i-th row (i=1 to M) are shown representatively. As shown in FIG. 2, each pixel PX is configured to include a liquid crystal element 22 and a selection switch 24. The liquid crystal element 22 is configured by a pixel electrode 221 and an opposing electrode 223 facing each other and a liquid crystal 225 that is pinched between the pixel electrode 221 and the opposing electrode 223. For example, a liquid crystal material of the TN type is appropriately used as the liquid crystal 225. The selection switch 24 (for example, an N-channel thin-film transistor) is disposed between the signal line 14 and the pixel electrode 221 so as to control electrical connection (conduction or non-conduction) therebetween. The opposing electrode 223 is maintained at a predetermined electric potential.

In the above-described configuration, the voltage of the signal line 14 at the moment when the selection switch 24 is transmitted to the ON state is applied to the pixel electrode 221. The transmittance (the reflectance in the case of the reflective type display) of the liquid crystal element 22 changes in accordance with a voltage between the pixel electrode 221 and the opposing electrode 223. The liquid crystal element 22 according to this embodiment is set to the normally-white mode. In other words, the transmittance of the liquid crystal element 22 becomes a maximum (100%) for a case where the voltage across the liquid crystal element 22 is zero and decreases as the voltage across the liquid crystal element 22 rises.

The control circuit 42 shown in FIG. 1 controls the driving circuit 30 by generating and outputting a synchronization signal or various control signals. The driving circuit 30 drives a plurality of the pixels PX under the control of the control circuit 42 so as to display an image in the pixel unit 10. To the driving circuit 30, gray scale data G that is used for designating the gray scale of each pixel PX is sequentially supplied from a higher-level device.

Figure 3:
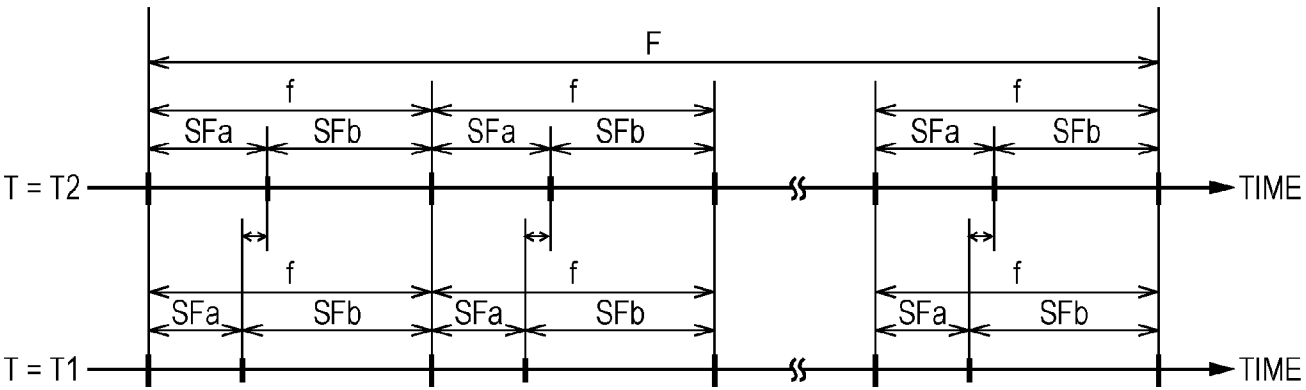
FIG. 3 is a schematic diagram illustrating subfield driving according to the first embodiment.

For driving each pixel PX by using the driving circuit 30, as shown in FIG. 3, a subfield driving method, in which either the ON voltage VON or the OFF voltage VOFF is applied to the liquid crystal element 22 (pixel electrode 221) of each pixel PX for each of a plurality of subfields SF (SFa and SFb) that is acquired by dividing each field F, is used. In the subfield driving, the ratio of a time interval (or a time internal in which the OFF voltage VOFF is applied) in which the ON voltage VON is applied to the liquid crystal element 22 to a time interval of a field F having a predetermined length is controlled to be changed in accordance with the gray scale data G (designated gray scale) of each pixel PX. The ON voltage VON is a voltage for changing the transmittance of the liquid crystal element 22 (that is, a voltage different from the voltage of the opposing electrode 223). On the other hand, the OFF voltage VOFF is a voltage that is set such that the voltage across the liquid crystal element 22 is lower than that for a case where the ON-voltage is applied (typically, the voltage across the liquid crystal element 22 is zero).

As shown in FIG. 3, one field F is divided into a plurality of unit periods f. Each unit period f is configured to include two subfields SF (SFa and SFb). The subfield (hereinafter, referred to as a gray scale control subfield) SFb set on the end point side within the unit period f is used for controlling the gray scale of each pixel PX (liquid crystal element 22) to be changed in accordance with the gray scale data G. In other words, the driving circuit 30 selectively applies either the ON voltage VON or the OFF voltage VOFF to the liquid crystal element 22 of each pixel PX in accordance with the gray scale data G for the gray scale control subfield SFb within the field F.

On the other hand, the subfield (hereinafter, referred to as a "temperature compensation subfield") SFa set on the start point side within the unit period f is used for compensating a change in the response characteristics of the liquid crystal 225 due to the temperature. The driving circuit 30 applies the ON voltage VON to the liquid crystal element 22 of each pixel PX for each temperature compensation subfield SFa within the field F regardless of the gray scale data G.

Figure 4:
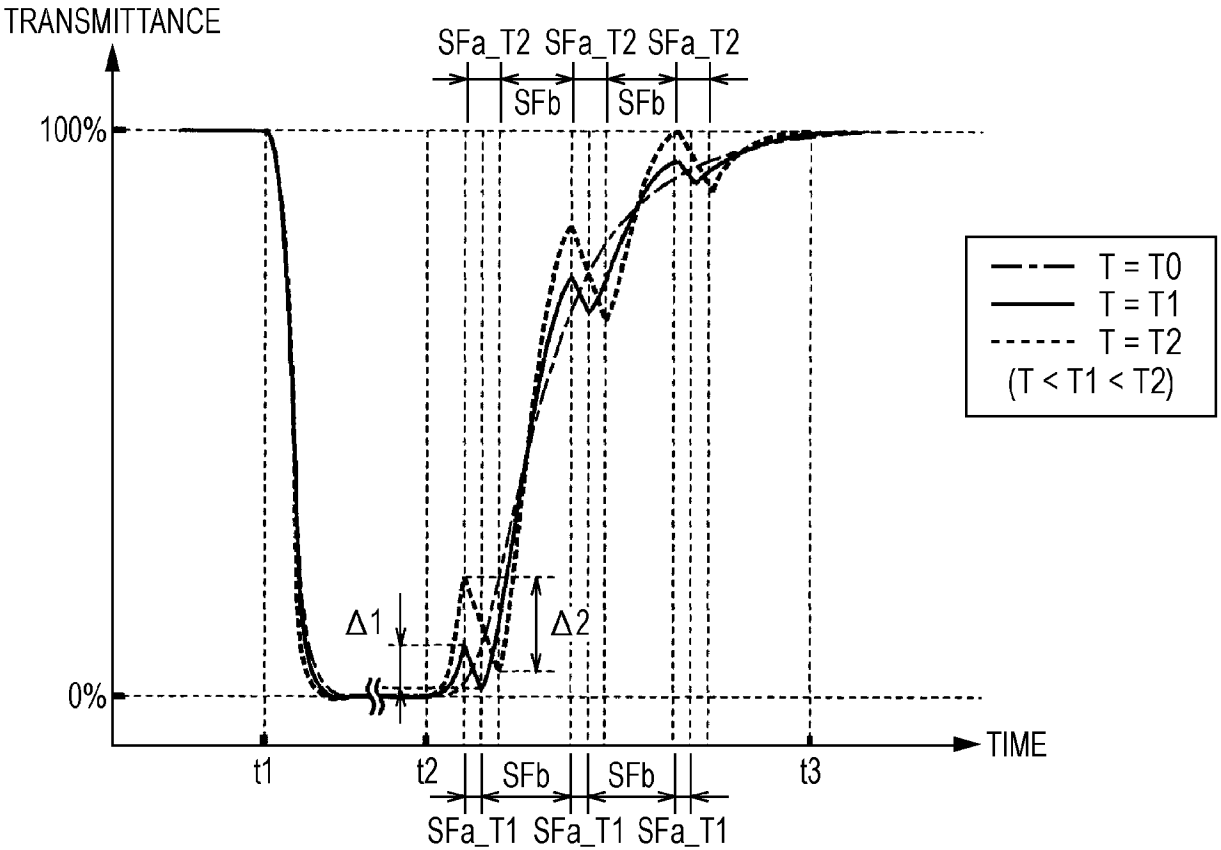
FIG. 4 is a graph showing a change in the transmittance of a liquid crystal element over time for each temperature.

FIG. 4 is a graph showing a change in the transmittance of the liquid crystal element 22 over time for a plurality of cases where the temperatures (T0, T1, and T2) of the liquid crystal 225 are different from one another. In FIG. 4, a case where the ON voltage VON is applied to the liquid crystal element 22 for each gray scale control subfield SFb of a plurality of unit periods f over a start point t1 to a time point t2 of the field F, and the OFF voltage VOFF is applied to the liquid crystal element 22 for each gray scale control subfield SFb of a plurality of unit periods f over the time point t2 to an end point t3 of the field F is considered.

When only the gray scale control subfield SFb is focused, the transmittance of the liquid crystal element 22 is decreased over time together with the application of the ON voltage that starts from the time point t1 and reaches the minimum value (saturation). Then, the transmittance of the liquid crystal element 22 is increased over time together with the application of the OFF voltage VOFF that starts from the time point t2 and reaches (saturation) the maximum value. On the other hand, by forcibly applying the ON voltage for each temperature compensation subfield SFa within the field F, the transmittance of the liquid crystal element 22 is decreased. Accordingly, as shown in FIG. 4, the transmittance of the liquid crystal element 22 within the time interval from the time point t2 to a time point t3 repeatedly decreases within each temperature compensation subfield SFa and to be increased in each gray scale control subfield SFb in an alternating manner so as to be increased over time as a whole.

The temperature detecting unit 44 shown in FIG. 1 is a sensor that detects the temperature T of each unit (ideally the liquid crystal 225) of the electro-optical device 100 or the surroundings of the electro-optical device 100. For example, a resistor (thermistor) of which resistance changes in accordance with the surrounding temperature T is appropriately used as the temperature detecting unit 44. The control circuit 42 controls the time length of the temperature compensation subfield SFa in each unit period f within the field F to change in accordance with the temperature T detected by the temperature detecting unit 44.

In particular, the control circuit 42 sets each temperature compensation subfield SFa so as to be lengthened as the temperature T detected by the temperature detecting unit 44 becomes higher. In other words, as shown in FIGS. 3 and 4, the time length of the temperature compensation subfield SFa (a reference sign of SFa_T2 shown in FIG. 4) in the case where the temperature T is a predetermined value T2 (for example, 60° C.) is set to be longer than that of the temperature compensation subfield SFa (a reference sign of SFa_T1 shown in FIG. 4) in the case where the temperature T is a predetermined value T1 (for example, 50° C.) that is lower than the above-described predetermined value T2. Accordingly, as the temperature T rises, the amount of change (the amount of decrease) in the transmittance of the liquid crystal element 22 within the temperature compensation subfield SFa is increased. For example, as shown in FIG. 4, the amount 42 of decrease in the transmittance within the temperature compensation subfield SFa_T2 in the case where the temperature T is the predetermined value T2 is larger than the amount Δ1 of decrease in the transmittance within the temperature compensation subfield SFa_T1 in the case where the temperature T is the predetermined value T1.

In addition, when the temperature T is equal to or lower than a predetermined value T0 (for example, 40° C.), the control circuit 42 sets the time length of the temperature compensation subfield SFa to zero. Accordingly, as denoted by a long dotted line in FIG. 4, the transmittance of the liquid crystal element 22 is increased continuously (that is, not decreased in the middle) after the time point t2 and reaches the maximum value. Here, the time length of the unit period f is fixed. Accordingly, as the temperature T becomes higher, the gray scale control subfield SFb is set to a shorter time interval.

Figure 13:
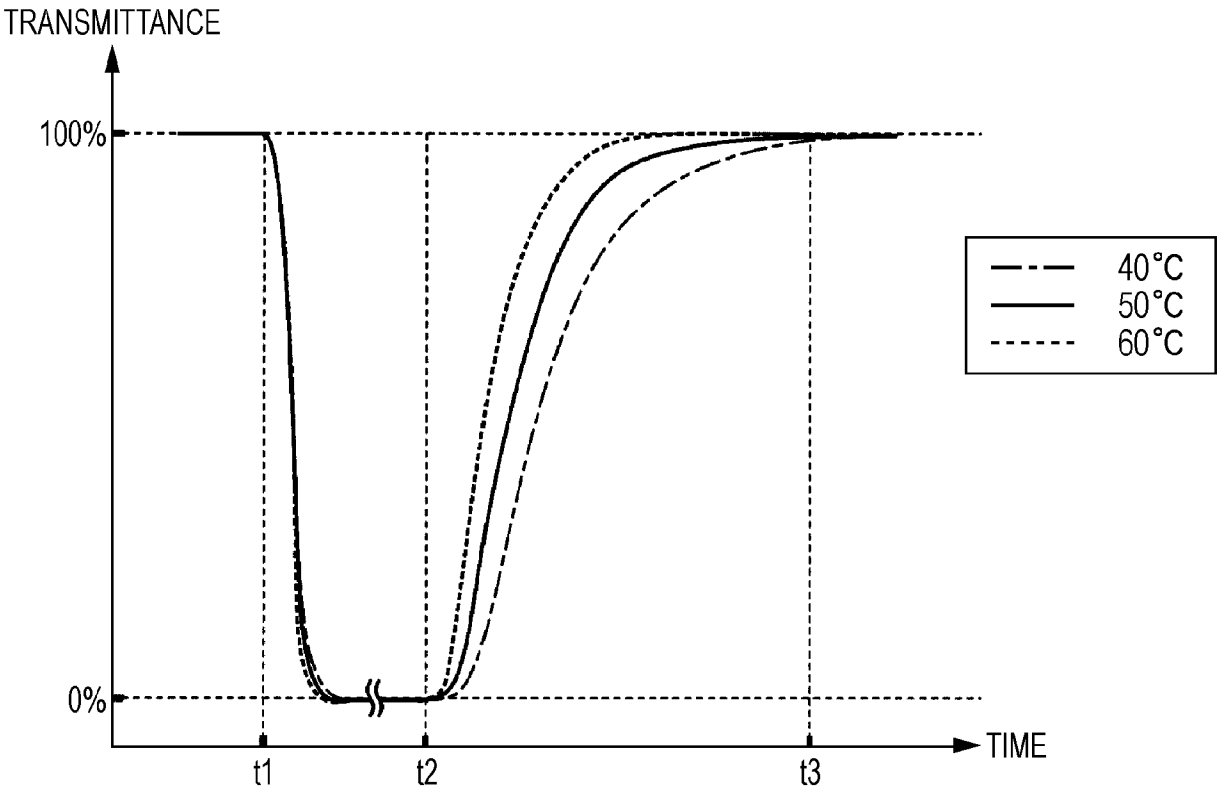
FIG. 13 is a graph illustrating a change in the transmittance of an electro-optical element (liquid crystal element) over time.

As can be noticed from FIG. 4 or the above-described FIG. 13, as the temperature of the liquid crystal 225 is higher, the speed at which the transmittance of the liquid crystal element 22 is increased in accordance with the application of the OFF voltage VOFF becomes higher. In the first embodiment, as the temperature T of the liquid crystal 225 is higher (that is, as the increase in the transmittance due to the application of the OFF voltage VOFF is faster), the amount of decrease in the transmittance within the temperature compensation subfield SFa is increased. Thus, as shown in FIG. 4, even when the temperatures T are different, the transmittance of the liquid crystal element 22 at each time point on the time axis approaches closely. Accordingly, the change in the gray scale due to the temperature T can be decreased. In addition, the gray scale perceived by an observer depends on the time integral of the transmittance. Accordingly, even when the shapes of curves representing the changes in the transmittance over time are different from each other, as shown in FIG. 4, the difference in the gay scale that is actually perceived by the observer is effectively reduced.

Figure 5:
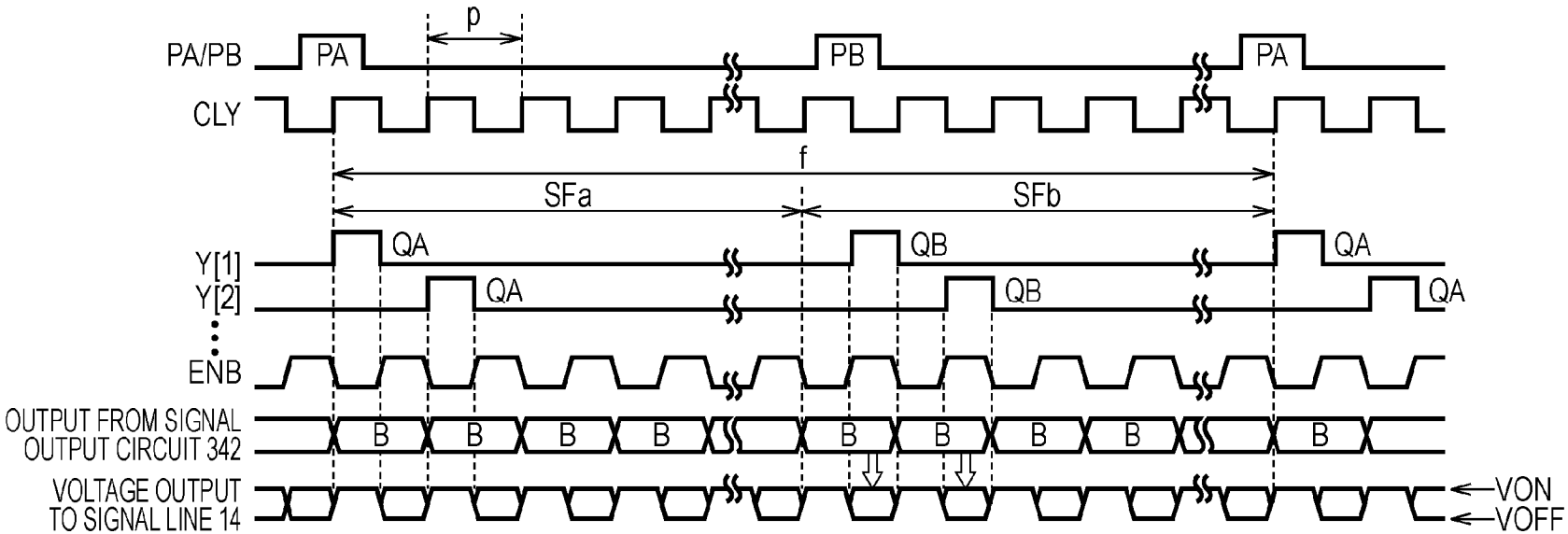
FIG. 5 is a timing chart showing the operation of a driving circuit.

Next, a detailed configuration of the driving circuit 30 will be described. As shown in FIG. 1, the driving circuit 30 is configured to include a scanning line driving circuit 32, a signal line driving circuit 34, and a conversion circuit 36. The scanning line driving circuit 32 generates scanning signals Y[1] to Y[M] that are used for sequentially selecting the M scanning lines 12 and outputs the scanning signals to the scanning lines 12. In particular, the scanning line driving circuit 32 sets a scanning signal Y[i] to be supplied to the scanning line 12 of a selected row to a high-level voltage for allowing the selection switch 24 to transit to the ON state. As shown in FIG. 5, the scanning line driving circuit 32 sequentially selects the M scanning lines 12 for each subfield SF (the temperature compensation subfield SFa and the gray scale control subfield SFb) within each field F. In other words, selection is performed twice for one scanning line 12 for every unit period f.

The scanning line driving circuit 32 according to the first embodiment is a shift register circuit of M levels corresponding to a total number of the scanning lines 12. In other words, the scanning line driving circuit 32, as shown in FIG. 5, sequentially shifts start pulses (PA and PB) in synchronization with a clock signal CLY (period p) supplied from the control circuit 42 and outputs the shifted start pulses to the scanning lines 12. As shown in FIG. 5, the control circuit 42 sequentially outputs the start pulse PA and the start pulse PB to the scanning line driving circuit 32 for each unit period f within the field F.

Accordingly, in each scanning signal Y[i], a selection pulse QA for transmitting the start pulse PA and a selection pulse QB for transmitting the start pulse PB are disposed. The selection pulse QA of the scanning signal Y[i] defines a start point of the temperature compensation subfield SFa for each pixel PX of the i-th row, and the selection pulse QB of the scanning signal Y[i] defines a start point of the gray scale control subfield SFb for each pixel PX of the i-th row. The interval between the selection pulse QA of the scanning signal Y[i] and the selection pulse QA of the scanning signal Y[i+1] of the next row and the interval between the selection pulse QB of the scanning signal Y[i] and the selection pulse QB of the scanning signal Y[i+1] correspond to a half period (p/2) of the clock signal CLY.

The conversion circuit 36 shown in FIG. 1 converts the gray scale data G of each pixel PX into direction data D. The direction data D is a bit row that designates either the ON voltage VON or the OFF voltage VOFF to each of a plurality of gray scale control subfields SFb within the field F. The conversion circuit 36 generates the direction data D from the gray scale data G such that the number of the gray scale control subfields SFb, for which the ON voltage VON is designated by the direction data D, is decreased (that is, the time length within the field F in which the transmittance of the liquid crystal element 22 is set to the minimum value due to the application of the ON voltage VON is shortened) as the gray scale designated by the gray scale data G is higher. For example, a table in which each value of the gray scale data G is associated with each value of the direction data D is employed as the conversion circuit 36. In addition, a direction for applying the ON voltage VON in each temperature compensation subfield SFa is not included in the direction data D.

The signal line driving circuit 34 supplies the ON voltage VON or the OFF voltage VOFF to each signal line 14 in synchronization with selection of each scanning line 12 that is performed by the scanning line driving circuit 32. The voltage output to each signal line 14 for each of the plurality of gray scale control subfields SFb within the field F at the time when the scanning line 12 is selected is set to either the ON voltage VON or the OFF voltage VOFF in accordance with the direction data D. In particular, when the scanning line 12 of the i-th row is selected in the gray scale control subfield SFb, the signal line driving circuit 34 outputs a voltage (either the ON voltage VON or the OFF voltage VOFF), which is designated by the direction data D generated from the gray scale data G of the pixel PX located in the j-th column of the i-th row for the corresponding gray scale control subfield SFb, to the signal line 14 of the j-th column.

On the other hand, when the scanning line 12 is selected in each temperature compensation subfield SFa within the field F, the signal line driving circuit 34 outputs the ON voltage VON to the N signal lines 14 regardless of the direction data D. Accordingly, the ON voltage VON is forcibly applied to the liquid crystal element 22 in each of the plurality of temperature compensation subfields SFa within the field F.

Figure 6:
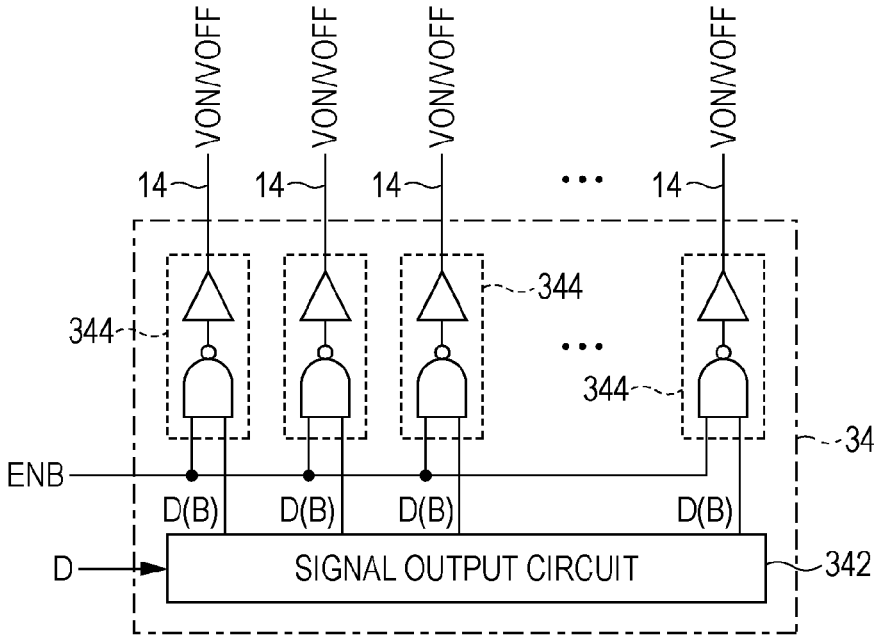
FIG. 6 is a block diagram of a signal line driving circuit.

FIG. 6 is a block diagram of the signal line driving circuit 34. As shown in FIG. 6, the signal line driving circuit 34 is configured to include a signal output circuit 342 to which the direction data D is sequentially supplied from the conversion circuit 36 and N logic circuits 344 corresponding to the signal lines 14. As shown in FIG. 5, the signal output circuit 342 sequentially outputs each bit B of the direction data D[j] of each pixel PX in the j-th row to the logic circuit 344 of the j-th column at the period p of the clock signal CLY. A latch circuit of N levels that maintains each bit B of the direction data D corresponding to the pixel PX of each column and outputs the bit at a predetermined period is used as the signal output circuit 342.

To each logic circuit 344, a control signal ENB is supplied from the control circuit 42. The control signal ENB, as shown in FIG. 5, is set to the low level at the time when each scanning line 12 is selected in each temperature compensation subfield SFa and is set to the high level at the time when each scanning line 12 is selected in each gray scale control subfield SFb. In other words, an interval in which the control signal ENB is set to the low level is overlapped with a selection pulse QA of one of the scanning signals Y[1] to Y[M], and an interval in which the control signal ENB is set to the high level is overlapped with a selection pulse QB of one of the scanning signals Y[1] to Y[M].

The logic circuit 344 of the j-th column selects either the ON voltage VON or the OFF voltage VOFF in accordance with the control signal ENB supplied from the control circuit 42 and the bit B of the direction data D[j] supplied from the signal output circuit 342 and outputs the selected voltage to the signal line 14 of the j-th column. In particular, in the period during which the control signal ENB is at the low level, the logic circuit 344 outputs the ON voltage VON to the signal line 14 of the j-th column regardless of the direction data D[j] supplied from the signal output circuit 342. On the other hand, in the period during which the control signal ENB is at the high level, the logic circuit 344 outputs either the ON voltage VON or the OFF voltage VOFF in accordance with the direction data D[j] supplied from the signal output circuit 342 to the signal line 14 of the j-th column. As shown in FIG. 6, a combination of a NAND circuit to which the control signal ENB and the direction data D[j] are input and a buffer circuit that outputs either the ON voltage VON or the OFF voltage VOFF is very appropriate as the logic circuit 344.

As described above, within the period (temperature compensation subfield SFa) in which the control signal ENB is at the low level, the ON voltage VON is output to the signal line 14 regardless of the bit B of the direction data D[j]. Accordingly, even in a configuration in which the voltage (VON or VOFF) of each signal line 14 is changed for each time interval corresponding to a half period (p/2) of the clock signal CLY, the time length corresponding to the period p of the clock signal CLY can be acquired as the output period of each bit B of the direction data D. Accordingly, for example, compared to a case where the application of the ON voltage VON in the temperature compensation subfield SFa, in addition to the direction for the voltage (VON or VOFF) in the gray scale control subfield SFb, is directed by the direction data D (that is, a configuration in which each bit B of the direction data D output by the signal output circuit 342 is change for each half period of the clock signal CLY), there is an advantage in that the required operating speed of the signal line driving circuit 34 is decreased. However, also the configuration in which each bit B of the direction data D output by the signal output circuit 342 is changed for each half period of the clock signal CLY belongs to the scope of the invention.

B. Second Embodiment

Next, a second embodiment of the invention will be described. In addition, to each element of embodiments described below that is equivalent to that of the first embodiment in terms of the action or the function, a reference sign that is the same as that in the first embodiment is assigned, and a detailed description thereof will be appropriately omitted.

Figure 7:
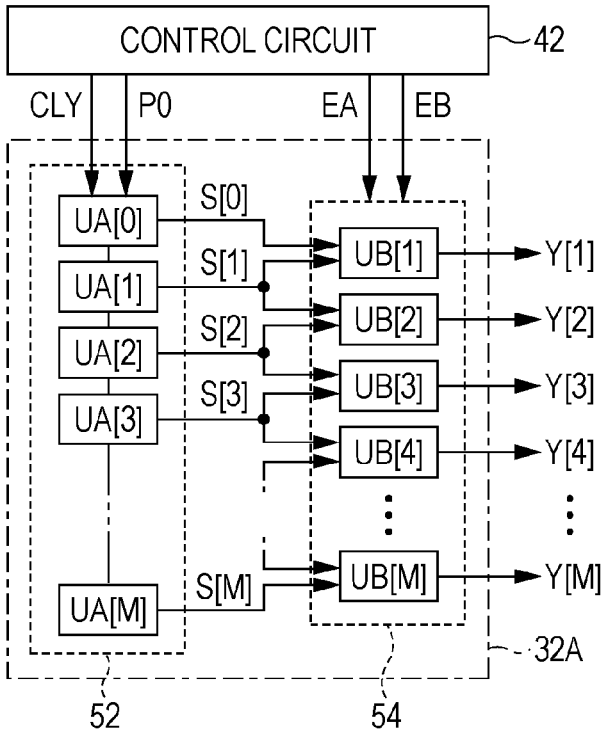
FIG. 7 is a block diagram of a scanning line driving circuit of an electro-optical device according to a second embodiment of the invention.

In an electro-optical device 100 according to the second embodiment, a scanning line driving circuit 32A shown in FIG. 7 is used for selecting each scanning line 12. To the scanning line driving circuit 32A, a start pulse P0 is supplied from the control circuit 42. According to the scanning line driving circuit 32 of the first embodiment, the selection pulse QA of each scanning signal Y[i] is generated from the start pulse PA, and the selection pulse QB of each scanning signal Y[i] is generated from the start pulse PB. However, according to the scanning line driving circuit 32A of the second embodiment, both the selection pulse QA and the selection pulse QB of each scanning signal Y[i] are generated from one start pulse P0. Accordingly, one start pulse P0 is supplied from the control circuit 42 to the scanning line driving circuit 32A for each unit period f.

As shown in FIG. 7, the scanning line driving circuit 32A is configured to include a transmission circuit 52 and a pulse generating circuit 54. The transmission circuit 52 is a shift register that generates (M+1) affiliate transmission signals S[0] to S[M] acquired by sequentially shifting (delaying) the start pulse P0 supplied from the control circuit 42. As shown in FIG. 7, the transmission circuit 52 is configured by unit circuits (flip-flops) UA[0] to UA[M] of (M+1)-stages from the 0-th stage to the M-th stage. To the unit circuits UA[0] to UA[M], a clock signal CLY is supplied from the control circuit 42.

Figure 8:
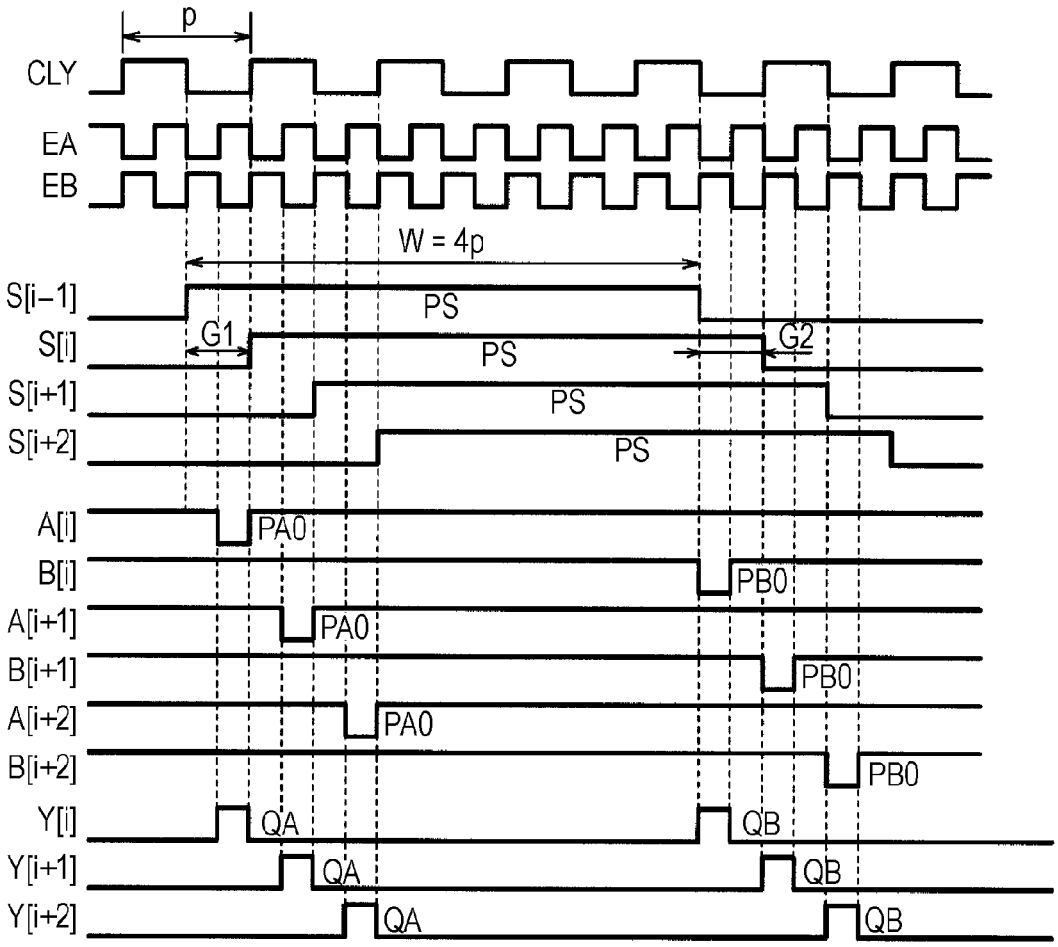
FIG. 8 is a timing chart showing the operation of a scanning line driving circuit.

As shown in FIG. 8, the unit circuit UA[i] of the i-th stage generates a transmission signal S[i] by delaying a transmission signal S[i−1] (the start pulse P0 output from the control circuit 42 for the unit circuit UA[0] of the 0-th stage) output by the unit circuit UA[i−1] of the previous stage by a half period (p/2) of the clock signal CLY and outputs the transmission signal S[i]. Accordingly, in each of the transmission signals S[0] to S[M], a transmission pulse PS having the pulse width of W corresponding to the start pulse P0 is disposed. In FIG. 8, a case where the pulse width of the start pulse P0 is set such that the pulse width W of the transmission pulse PS is four times the period (4 p) of the clock signal CLY is exemplified for the convenience of description. As shown in FIG. 8, the transmission pulses PS of the transmission signals S[i] having adjacent phases are overlapped with each other on the time axis.

The pulse generating circuit 54 shown in FIG. 7 generates M affiliate scanning signals Y[1] to Y[M] from the transmission signals S[0] to S[M]. As shown in FIG. 7, the pulse generating circuit 54 is configured to include M unit circuits UB[1] to UB[M] corresponding to a total number of the scanning lines 12. To the unit circuits UB[1] to UB[M], control signals EA and EB having opposite logic levels are supplied from the control circuit 42. As shown in FIG. 8, the control signals EA and EB are periodic signals of which logic levels are changed in accordance with a half-period (p/2) of the clock signal CLY.

Figure 9:
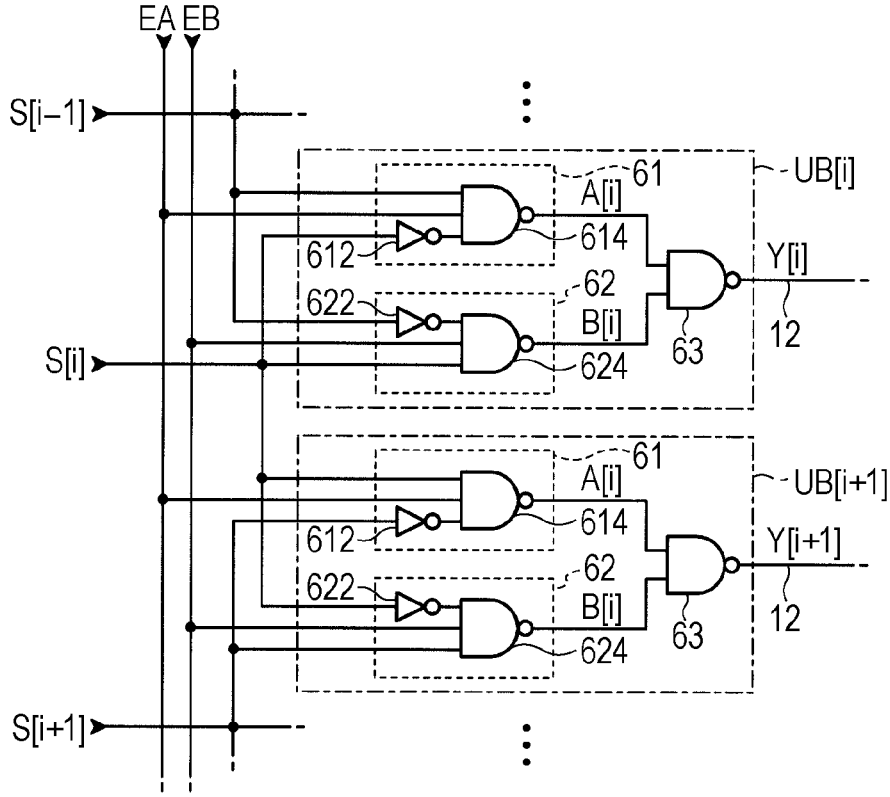
FIG. 9 is a circuit diagram of each unit circuit that configures a pulse generating circuit.

In FIG. 9, the configuration of the unit circuit UB[i] of the i-th stage is shown representatively. As shown in FIGS. 7 and 9, the unit circuit UB[i] generates a scanning signal Y[i] of the i-th row from the transmission signal S[i] of the unit circuit UB[i] and the transmission signal S[i−1] of the previous stage. As shown in FIG. 9, the unit circuit UB[i] is configured to include a logic circuit 61, a logic circuit 62, and a NAND circuit 63. The logic circuit 61 generates a signal of A[i], and the logic circuit 62 generates a signal of B[i].

As shown in FIG. 9, the logic circuit 61 is configured by an inverter circuit 612 and a NAND circuit 614. The inverter circuit 612 inverts the logic level of the transmission signal S[i]. The NAND circuit 614 outputs a negative AND of the output signal of the inverter circuit 612, the transmission signal S[i−1] of the previous stage, and the control signal EA as a signal A[i]. Accordingly, the signal A[i], as shown in FIG. 8, is set to the low level in an interval, in which the control signal EA is at the high level, of an interval (a low-level interval of the transmission signal S[i] before generation of the transmission pulse PS) G1 in which the logic level is opposite to that of the transmission signal S[i−1] in the leading edge of the transmission pulse PS of the transmission signal S[i] and is maintained at the high level in the other intervals. In other words, in the signal A[i], a pulse PAO corresponding to the leading edge of the transmission pulse PS of the transmission signal S[i] is generated. As described above, the logic circuit 61 is used for detecting the leading edge of the transmission pulse PS.

The logic circuit 62 shown in FIG. 9, similarly to the logic circuit 61, is configured by an inverter circuit 622 and a NAND circuit 624. The inverter circuit 622 inverts the logic level of the transmission signal S[i−1] of the previous stage. The NAND circuit 624 outputs a negative AND of the output signal of the inverter circuit 622, the transmission signal S[i] of the current stage, and the control signal EB as a signal B[i]. Accordingly, the signal B[i], as shown in FIG. 8, is set to the low level in an interval, in which the control signal EB is at the high level, of an interval (a low-level interval of the transmission signal S[i−1] after generation of the transmission pulse PS) G2 in which the logic level is opposite to that of the transmission signal S[i−1] in the trailing edge of the transmission pulse PS of the transmission signal S[i] and is maintained at the high level in the other intervals. In other words, in the signal B[i], a pulse PB0 corresponding to the trailing edge of the transmission pulse PS of the transmission signal S[i] is generated. As described above, the logic circuit 62 is used for detecting the trailing edge of the transmission pulse PS.

The NAND circuit 63 shown in FIG. 9 outputs a negative AND of the signal A[i] output by the logic circuit 61 (NAND circuit 614) and the signal B[i] output by the logic circuit 62 (NAND circuit 624) to the scanning line 12 as a scanning signal Y[i]. Accordingly, in the scanning signal Y[i], as shown in FIG. 8, a selection pulse QA corresponding to the pulse PAO (that is, the leading edge of the start pulse P0) of the signal A[i] and a selection pulse QB corresponding to the pulse PB0 (that is, the trailing edge of the start pulse P0) of the signal B[i] are generated. As M unit circuits UB[1] to UB[M] respectively perform the above-described operation, the scanning signals Y[1] to Y[M] having the same waveform as that of the first embodiment are generated. The operations of the signal line driving circuit 34 and each pixel PX are the same as those of the first embodiment.

The pulse width W of the transmission pulse PS in the transmission signal S[i] is changed in accordance with the pulse width of the start pulse P0. Accordingly, a time difference (moreover the time length of the temperature compensation subfield SFa) between the selection pulse QA corresponding to the leading edge of the transmission pulse PS and the selection pulse QB corresponding to the trailing edge is set to be changed in accordance with the pulse width of the start pulse P0. The control circuit 42 sets the pulse width (the pulse width W of the transmission pulse PS) of the start pulse P0 to a longer time as the temperature T detected by the temperature detecting unit 44 is higher. Accordingly, similarly to the first embodiment, as the temperature T is higher, the temperature compensation subfield SFa is set to a longer time, and the amount of decrease in the transmittance of the liquid crystal element 22 within the temperature compensation subfield SFa is increased.

According to the second embodiment, the same advantages as those of the first embodiment are acquired. In addition, in the second embodiment, the selection pulse QA and the selection pulse QB within the unit period f for each of the scanning signals Y[1] to Y[M] are generated from one start pulse P0. Accordingly, compared to the first embodiment in which start pulses (PA and PB) different from each other are needed for generating the selection pulse QA and the selection pulse QB, the number of the start pulses needed for generating the scanning signals Y[1] to Y[M] is decreased to be a half. Therefore, there is an advantage that the power consumption needed for generating and processing the start pulse is decreased.

C. Modified Examples

The above-described embodiments can be modified in various forms. Detailed modified forms of the above-described embodiments will be exemplified as below. In addition, two or more forms arbitrarily selected from among the examples below can be appropriately combined.

1. Modified Example 1

In each of the above-described embodiment, the temperature compensation subfield SFa is set for each unit period f within each field F (the ratio of the number of the temperature compensation subfields SFa to the number of the gray scale control subfields SFb is set to 1:1). However, according to an embodiment of the invention, the relation between the temperature compensation subfield SFa and the gray scale control subfield SFb may be arbitrarily set. For example, a total number of the temperature compensation subfield SFa and a total number of the gray scale control subfield SFb may be configured to be different within the field F. In addition, the position of the temperature compensation subfield SFa on the time axis may be arbitrarily set. However, as can be understood from the examples shown in FIGS. 4 and 13, the difference in the response characteristics of the liquid crystal 225 in response to the temperature T becomes apparent at the time of applying of the OFF voltage VOFF. Accordingly, it is preferable that the temperature compensation subfield SFa is set in the latter period (for example, a period from the center point to the end point within the field F) of the field F.

As can be understood from the description as above, the driving circuit 30 is included as an element that applies the ON voltage VON to the pixel PX in at least one temperature compensation subfield SFa from among a plurality of subfields SF (SFa and SFb) within the field F and applies either the ON voltage VON or the OFF voltage VOFF to the pixel PX in accordance with the gray scale data G of the pixel PX in each of a plurality of gray scale control subfields SFb among the plurality of subfields SF. Thus, according to an embodiment of the invention, the number of the temperature compensation subfields SFa within the field F or the relation between the temperature compensation subfield SFa and the gray scale control subfield SFb may be arbitrarily set.

2. Modified Example 2

In each of the above-described embodiments, a plurality of the unit periods f that configures the field F is set to have a same time length. However, a configuration in which the time lengths of the unit periods f within the field F are different from one another may be used. In addition, a configuration in which the time lengths of the gray scale control subfields SFb within the field F are different from one another may be appropriately used. For example, in a configuration in which the time lengths of the plurality of gray scale control subfields SFb within the field F are set to be binary-weighted, the number of the gray scales can be increased, compared to a case where the gray scale control subfields SFb are set to have a same time length.

3. Modified Example 3

In each of the above-described embodiment, the liquid crystal element 22 of the normally-white mode has been described as an example. However, the invention may be also applied to an electro-optical device that uses a liquid crystal element 22 of the normally-black mode in which the transmittance becomes the maximum at the time of applying the ON voltage VON. In addition, the display type of the liquid crystal element 22 is not limited to the transmissive type in which light emitted from the rear face side is output to the observation side. Thus, a reflective type in which incident light from the observation side is reflected so as to be used for display or a semi-transmissive reflection type in which an image is displayed in both the transmissive manner and the reflective manner may be used.

Above all, the liquid crystal element 22 is only an example of an electro-optical element. Whether the electro-optical element used in the electro-optical device according to an embodiment of the invention is the self-emission type in which the electro-optical element emits light or the non-emission type (for example, the liquid crystal element 22) in which the transmittance or the reflectance for external light is changed or the current-driven type being driven by supply of a current or the voltage-driven type being driven by applying an electric field (voltage) does not matter. For example, the invention can be applied to an electro-optical device that uses various electro-optical elements such as an inorganic EL element, an organic EL element, a FE (field-emission) element, a SE (surface conduction electron emitter) element, a BS (ballistic electron emitting) element, an LED (light emitting diode) element, an electrophoretic element, or an electrochromic element. In other words, the electro-optical element is an element of which the gray scale (optical characteristics such as transmittance or luminance) is changed by an electrical action such as supply of a current or application of a voltage (electric field).

D. Applications

Figure 10:
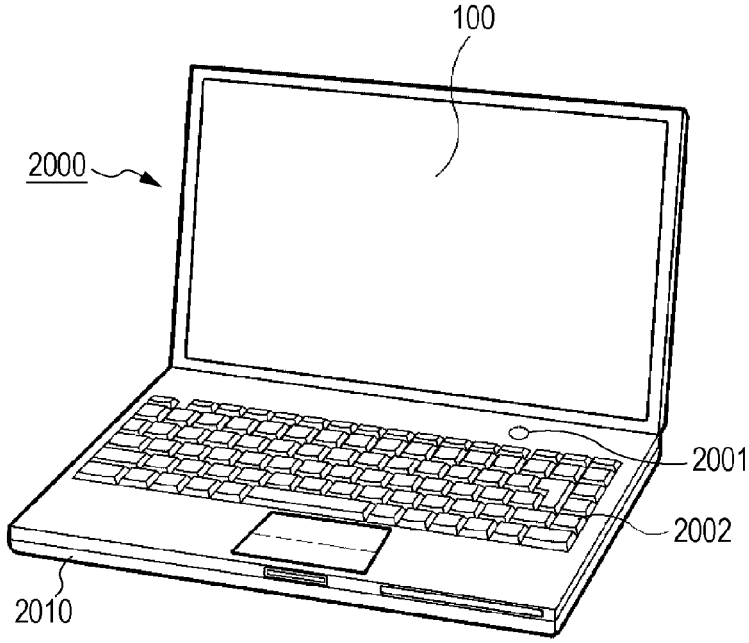
FIG. 10 is a perspective view of an electronic apparatus (personal computer).

Next, an electronic apparatus using the electro-optical device 100 according to each of the above-described embodiments will be described. FIG. 10 is a perspective view showing the configuration of a mobile-type personal computer that uses the electro-optical device 100. The personal computer 2000 includes the electro-optical device 100 that displays various images and a main unit 2010 in which a power switch 2001 and a keyboard 2002 are installed.

Figure 11:
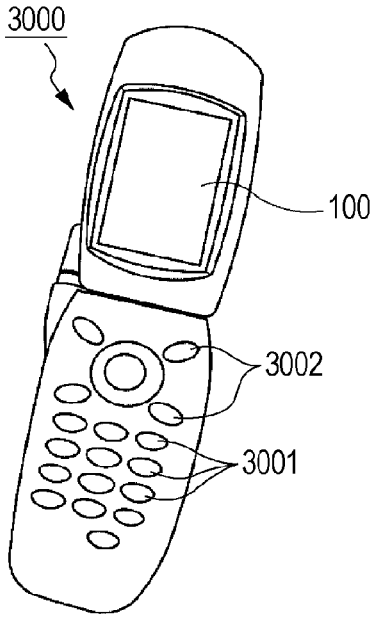
FIG. 11 is a perspective view of an electronic apparatus (cellular phone).

FIG. 11 is a perspective view showing the configuration of a cellular phone in which the electro-optical device 100 is used. The cellular phone 3000 includes a plurality of operation buttons 3001, scroll buttons 3002, and an electro-optical device 100 that displays various images. By operating the scroll buttons 3002, the screen displayed in the electro-optical device 100 is scrolled.

Figure 12:
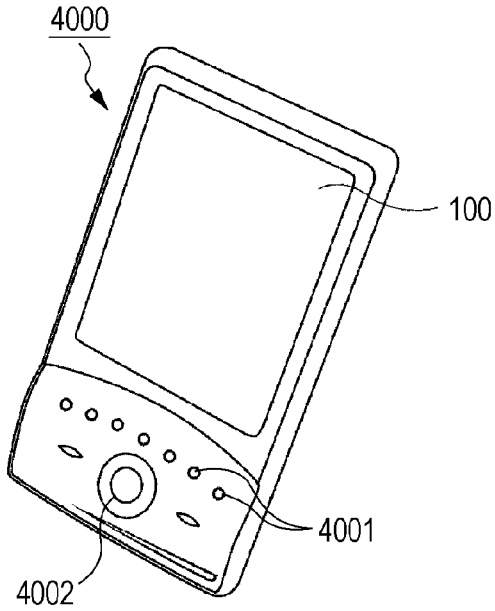
FIG. 12 is a perspective view of an electronic apparatus (personal digital assistants).

FIG. 12 is a perspective view showing the configuration of a PDA (personal digital assistants) in which the electro-optical device 100 is used. The PDA 4000 includes a plurality of operation buttons 4001, a power switch 4002, and an electro-optical device 100 that displays various images. When the power switch 4002 is operated, various types of information such as an address book or a schedule book is displayed in the electro-optical device 100.

As electronic apparatuses in which the electro-optical device according to an embodiment of the invention is used, there are a digital still camera, a digital camera, a television set, a video camera, a car navigation system, a pager, an electronic calendar, an electronic paper sheet, a calculator, a word processor, a workstation, a video phone, a POS terminal, a printer, a scanner, a copier, a video player, a projector, and an apparatus having a touch panel, in addition to the apparatuses exemplified in FIGS. 10 to 12.

The entire disclosure of Japanese Patent Application No. 2009-014365, filed Jan. 26, 2009 is expressly incorporated by reference herein.

What is claimed is:

1. An electro-optical device comprising:

pixels that are disposed in correspondence with intersections of scanning lines and signal lines and are driven in response to an ON voltage or an OFF voltage supplied to the signal lines at a time when each of the scanning lines is selected;

a scanning line driving circuit that sequentially selects the scanning lines in each of a plurality of subfields within a field;

a signal line driving circuit that outputs the ON voltage to the signal lines at the time when each of the scanning lines is selected in at least one temperature compensation subfield among the plurality of subfields and outputs either the ON voltage or the OFF voltage to each of the signal lines in accordance with a designated gray scale of a pixel corresponding to the corresponding scanning line and the corresponding signal line at a time when each of the scanning lines selected in each of a plurality of gray scale control subfields, which is different from the temperature compensation subfield, out of the plurality of subfields;

a temperature detecting unit that detects a temperature; and a control unit that sets a time length of the temperature compensation subfield to be changed in accordance with the temperature detected by the temperature detecting unit, wherein the scanning line driving circuit includes:

a transmission circuit that generates a plurality of transmission signals in which transmission pulses acquired by sequentially shifting a start pulse are disposed; and a pulse generating circuit that generates a first selection pulse corresponding to a leading edge of each of the transmission pulses and a second selection pulse corresponding to a trailing edge of each of the transmission pulses and outputs the selection pulses to each of the scanning lines, wherein the first selection pulse directs to select each of the scanning lines in one of the temperature compensation subfield and the gray scale control subfield, and the second selection pulse directs to select each of the scanning lines in the other of the temperature compensation subfield and the gray scale control subfield, and wherein the control unit controls a pulse width of the start pulse in accordance with the temperature detected by the temperature detecting unit.

2. The electro-optical device according to claim 1, wherein the control unit sets the temperature compensation subfield to a longer time interval as the temperature detected by the temperature detecting unit is higher.

3. The electro-optical device according to claim 1, wherein the field is divided into a plurality of unit periods, and each of the plurality of unit periods includes the temperature compensation subfield and the gray scale control subfield.

4. The electro-optical device according to claim 1, wherein the signal line driving circuit includes:

a plurality of logic circuits corresponding to the signal lines; and a signal output circuit that supplies direction data that designates the ON voltage or the OFF voltage in a time-division manner to each of the plurality of logic circuits, wherein each of the plurality of logic circuits receives a control signal that is set to a first level at a time when each of the scanning lines is selected in the temperature compensation subfield and is set to a second level at a time when each of the scanning lines is selected in each of the plurality of gray scale control subfields and outputs the ON voltage to the signal lines within a period in which the control signal is at the first level regardless of the direction data and outputs the ON voltage or the OFF voltage in accordance with the direction data to the signal lines in a period in which the control signal is at the second level.

5. The electro-optical device according to claim 4, wherein each of the plurality of logic circuits includes a negative AND circuit to which the control signal and the direction data are input.

6. An electro-optical device comprising:

a pixel that disposed in correspondence with an intersection of a scanning line and a signal line and which is driven in accordance with an ON voltage or an OFF voltage;

a scanning line driving circuit that sequentially selects the scanning line in each of a plurality of subfields within a field;

a driving circuit that applies the ON voltage to the signal line at the time when the scanning line is selected in at least one temperature compensation subfield among a plurality of subfields within a field and applies either the ON voltage or the OFF voltage in accordance with a designated gray scale of the pixel to the pixel in each of a plurality of gray scale control subfields, which is different from the temperature compensation subfield, out of the plurality of subfields;

a temperature detecting unit that detects a temperature; and a control unit that sets a time length of the temperature compensation subfield to be changed in accordance with the temperature detected by the temperature detecting unit, wherein the scanning line driving circuit includes:

a transmission circuit that generates a plurality of transmission signals in which transmission pulses acquired by sequentially shifting a start pulse are disposed; and a pulse generating circuit that generates a first selection pulse corresponding to a leading edge of each of the transmission pulses and a second selection pulse corresponding to a trailing edge of each of the transmission pulses and outputs the selection pulses to each of the scanning lines, wherein the first selection pulse directs to select the scanning line in one of the temperature compensation subfield and the gray scale control subfield, and the second selection pulse directs to select each of the scanning line in the other of the temperature compensation subfield and the gray scale control subfield, and wherein the control unit controls a pulse width of the start pulse in accordance with the temperature detected by the temperature detecting unit.

* * * * *